US008009853B2

(12) United States Patent
Ito et al.

(10) Patent No.: US 8,009,853 B2
(45) Date of Patent: Aug. 30, 2011

(54) HEADPHONE DEVICE

(75) Inventors: Tomohiro Ito, Kanagawa (JP); Jo Wada, Tokyo (JP); Koji Nageno, Tokyo (JP)

(73) Assignee: Sony Corporation, Tokyo (JP)

( * ) Notice: Subject to any disclaimer, the term of this patent is extended or adjusted under 35 U.S.C. 154(b) by 1132 days.

(21) Appl. No.: 11/474,352

(22) Filed: Jun. 26, 2006

(65) Prior Publication Data

US 2007/0003093 A1 Jan. 4, 2007

(30) Foreign Application Priority Data

Jul. 4, 2005 (JP) ..... 2005-195220

(51) Int. Cl.
*H04R 25/00* (2006.01)

(52) U.S. Cl. ..... 381/381; 381/370
(58) Field of Classification Search ..... 381/370, 381/374, 381
See application file for complete search history.

(56) References Cited

U.S. PATENT DOCUMENTS

| | | | | |
|---|---|---|---|---|
| 4,882,769 | A * | 11/1989 | Gallimore | 455/344 |
| 6,195,441 | B1 * | 2/2001 | Ito | 381/381 |
| 6,233,345 | B1 * | 5/2001 | Urwyler | 381/381 |
| 2005/0100186 | A1 * | 5/2005 | Logan | 381/381 |
| 2005/0201585 | A1 * | 9/2005 | Jannard et al. | 381/381 |

FOREIGN PATENT DOCUMENTS

| | | | |
|---|---|---|---|
| JP | 55-44629 | | 3/1980 |
| JP | 55-56088 | | 4/1980 |
| JP | 58-66783 | | 5/1983 |
| JP | 63-61900 | | 4/1988 |
| JP | 3-68299 | | 3/1991 |
| JP | 10-294983 | | 11/1998 |
| JP | 11-225386 | | 8/1999 |
| JP | 2002-176689 | | 6/2002 |
| JP | 2002-238092 | | 8/2002 |
| JP | 2002238092 | A * | 8/2002 |
| WO | WO 2004/012477 | A2 | 2/2004 |
| WO | WO 2004/012477 | A3 | 2/2004 |

* cited by examiner

*Primary Examiner* — Curtis Kuntz
*Assistant Examiner* — Sunita Joshi
(74) *Attorney, Agent, or Firm* — Oblon, Spivak, McClelland, Maier & Neustadt, L.L.P.

(57) ABSTRACT

A headphone device includes: an approximately U-shaped band portion, the band portion being configured such that one and the other ends thereof are held on temples near upper ends of the left and right pinnas of a wearer and an intermediate portion thereof is positioned at the occiput of the wearer; left and right side connecting members connected to the band portion; left and right side housings connected to the band portion via the connecting members in a manner hanging from the band portion; and left and right side headphone drivers disposed in the left and right side housings, respectively.

20 Claims, 8 Drawing Sheets

HEADPHONE DEVICE

BACKGROUND OF THE INVENTION

1. Field of the Invention

The present invention relates to a headphone device, and particularly to a type of headphone device using a band.

2. Description of Related Art

Recently, as portable audio playback equipment becomes widespread, headphone devices, which are used by connecting to the playback equipment, have also been developed in various shapes. For example, inner ear types and neckband types are available.

Aside from small types such as the inner ear types worn directly on the pinnas, ordinary headphone devices include some kind of band, and are designed to attach left and right side headphone housings to one and the other ends of the band, respectively.

Japanese Patent Application Publication No. 2002-176689 discloses a headphone device of a so-called neckband type, in which a band is placed on the occiput of a wearer. When configured as such a neckband type, the headphone device superior in function as well as design can be obtained.

SUMMARY OF THE INVENTION

However, in the neckband type, due to the band being placed on the occiput of the wearer, there has been an issue such that a gap occurs between the occiput and the band. One solution to address the issue would be, e.g., to make the band itself to be expandable so as to fit the head size of the wearer. However, such an expandable configuration may lead to another issue such that the configuration of the band itself becomes complicated accordingly.

Furthermore, in the neckband type, the weight balance is such that the band itself does not weigh much, but the center of gravity is located at both ends of the band where the headphone housings are arranged. This means that the band itself tends to be raised easily. Furthermore, a still another issue has thus been addressed that the neckband type is not so well-balanced in terms of weight.

Accordingly, it is desirable to provide a headphone device capable of fitting to any wearer regardless of his/her head size. The present invention is conceived in view of the above-described issues.

A headphone device according to an embodiment of the present invention includes: an approximately U-shaped band portion, the band portion being configured such that one and the other ends thereof are held on temples near upper ends of the left and right pinnas of a wearer and an intermediate portion thereof is positioned at the occiput of the wearer; left and right side connecting members connected to the band portion; left and right side housings connected to the band portion via the connecting members in a manner hanging from the band portion; and left and right side headphone drivers disposed in the left and right side housings, respectively.

The above-described configuration allows the headphone housings hanging from the band portion to be worn on the left and right pinnas of the wearer, with the band portion being held on the temples near the upper ends of the left and right pinnas. Accordingly, the headphone device can be worn in such a way that the band portion is fitted to the shape of the head of the wearer.

According to the present invention, the headphone device can be worn, by fitting its band portion to the shape of the head of a wearer, whereby preferable wearing condition may be obtained regardless of the head size of the wearer.

DETAILED DESCRIPTION OF EMBODIMENTS

Referring to FIGS. 1-5, an embodiment of the present invention will be described below.

Figure 1:
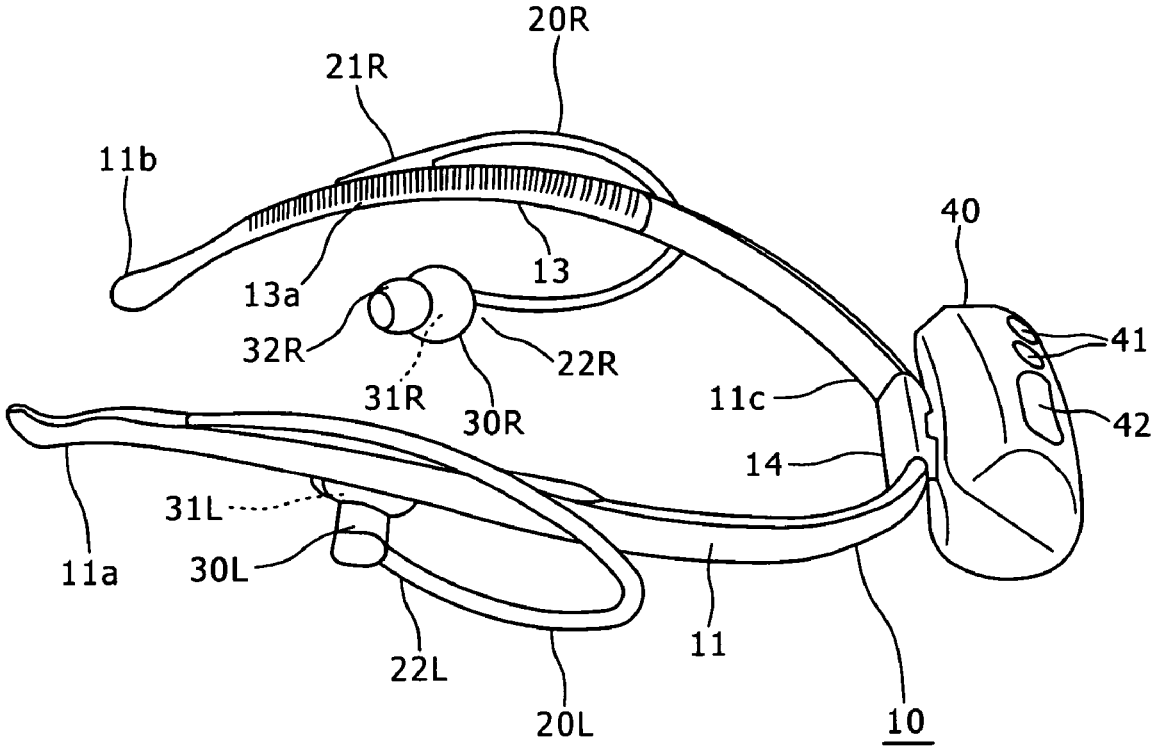
FIG. 1 is a perspective view showing, from a side, a configuration example according to an embodiment of the present invention.
Figure 2:
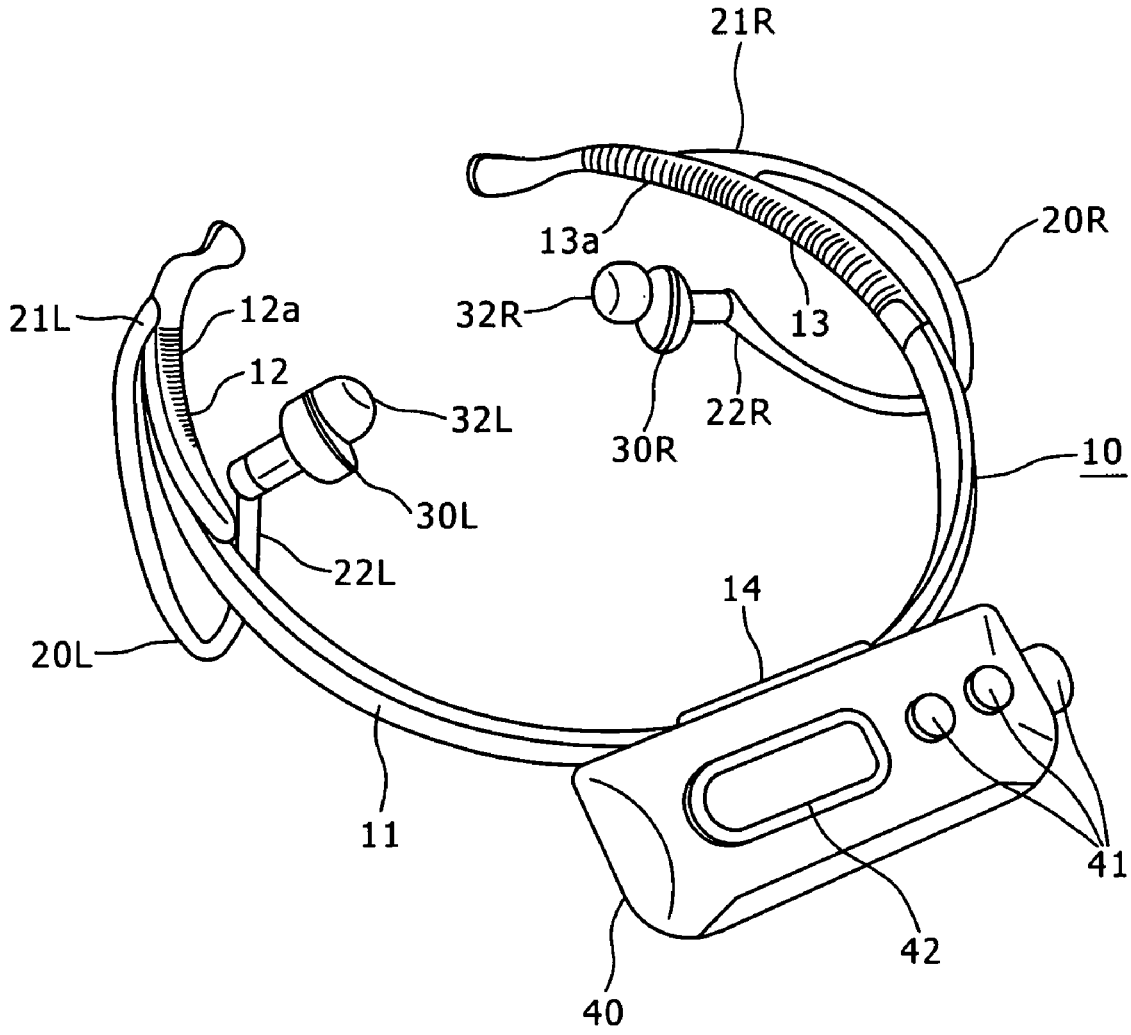
FIG. 2 is a perspective view showing, from the rear, a configuration example according to an embodiment of the present invention.
Figure 3:
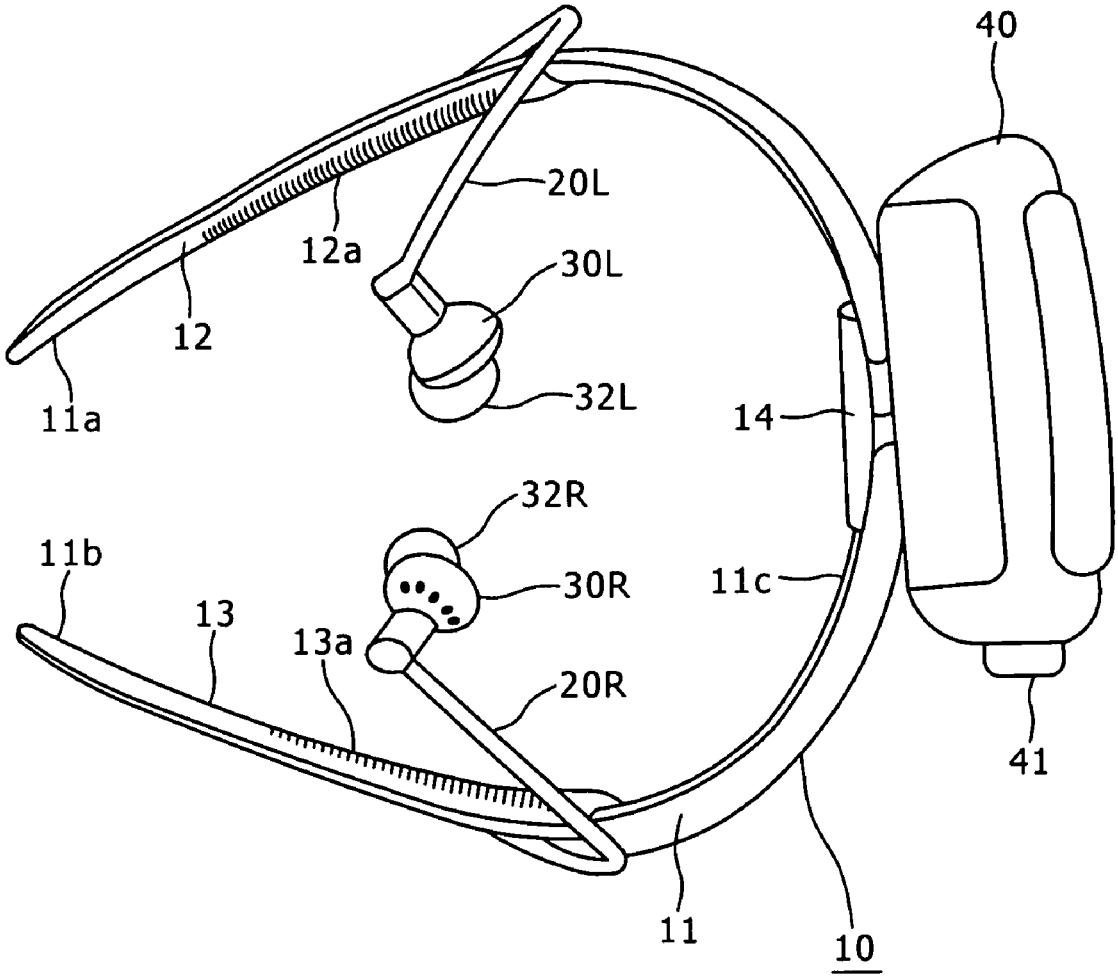
FIG. 3 is a plan view showing, from the bottom, a configuration example according to an embodiment of the present invention.

FIG. 1 is a perspective view of a headphone device of the present embodiment as seen from a side. FIG. 2 is a perspective view from the rear, and FIG. 3 is a plan view from the bottom. As shown in these FIGS. 1-3, the headphone device 10 of the present embodiment includes a band portion 11, with headphone housings 30L, 30R including therein driver units attached to positions more toward one and the other ends of the band portion 11, respectively. The band portion 11 is equal to or approximately U-shaped such that end portions 11*a*, 11*b* of one and the other sides thereof are held on the temples near the upper ends of the left and right pinnas of a wearer, respectively, and an intermediate portion thereof (a center portion 11*c*) is positioned at the occiput of the wearer. The U-shaped band portion 11 is formed with a member having some degree of elasticity, so that when it is worn, the band portion 11 may be held on the occiput by its elasticity. Furthermore, the band is somewhat upwardly curved at locations slightly inward of its end portions 11*a*, 11*b*.

Cushion members 12, 13 are attached to surfaces of the end portions 11*a*, 11*b* of the band portion 11, respectively. These cushion members 12, 13 provide comfortable contact against the corresponding portions of temples of the wearer when he/she wears the headphone device. A plurality of grooves 12*a*, 13*a* are disposed to cover a part of an inner side portion of each of the cushion members 12, 13, to function as means for preventing slippage when the device is worn. Each of the grooves 12*a*, 13*a* extends in a direction crossing the longitudinal direction of the band portion 11.

Furthermore, near the end portions 11*a*, 12*b* of the band portion 11, housing connecting members 20L, 20R are disposed. These housing connecting members 20L, 20R are formed from, e.g., a resin member having flexibility, and are attached to the end portions 11*a*, 11*b* so as to hang from connecting sections 21L, 21R in such a curved shape as to depict an arc, as shown in FIGS. 1, 2. The curvature of the housing connecting members 20L, 20R is made adjustable to some extent, so that they can be fitted in position with respective ears of the wearer.

The headphone housings 30L, 30R are attached to the end portions of the housing connecting members 20L, 20R, respectively. The headphone housings 30L, 30R include therein the driver units 31L, 31R, respectively. Audio signals outputted from the driver units 31L, 31R are outputted to the outside via earpieces 32L, 32R, and thus the wearer can hear the sound through his/her ears, on which these earpieces 32L, 32R are worn.

Further, the headphone device 10 of the present embodiment has a casing 40 that is molded using a resin or the like, and attached to the center portion 11*c* of the band portion 11. A casing connecting member 14 is attached to the center portion 11*c* of the band portion 11. The casing 40 includes therein circuits for audio signal processing and the like. The casing connecting member 14 may likewise be formed from a material having a cushioning property.

The casing 40 of the present embodiment has a horizontally-long shape, and contains a memory for storing audio data, and performs processing for supplying reproduced data from the memory to the headphone drivers. In the present embodiment, keys 41 for audio playback control and a display section 42 for displaying playback conditions are disposed in the casing 40. It should be noted that although not shown in FIGS. 1-3, the band portion 11 and the housing connecting members 20L, 20R include therein audio signal lines, so that audio signals outputted from the casing 40 are supplied to the driver units 31L, 31R within the headphone housings 30L, 30R, respectively.

Figure 4:
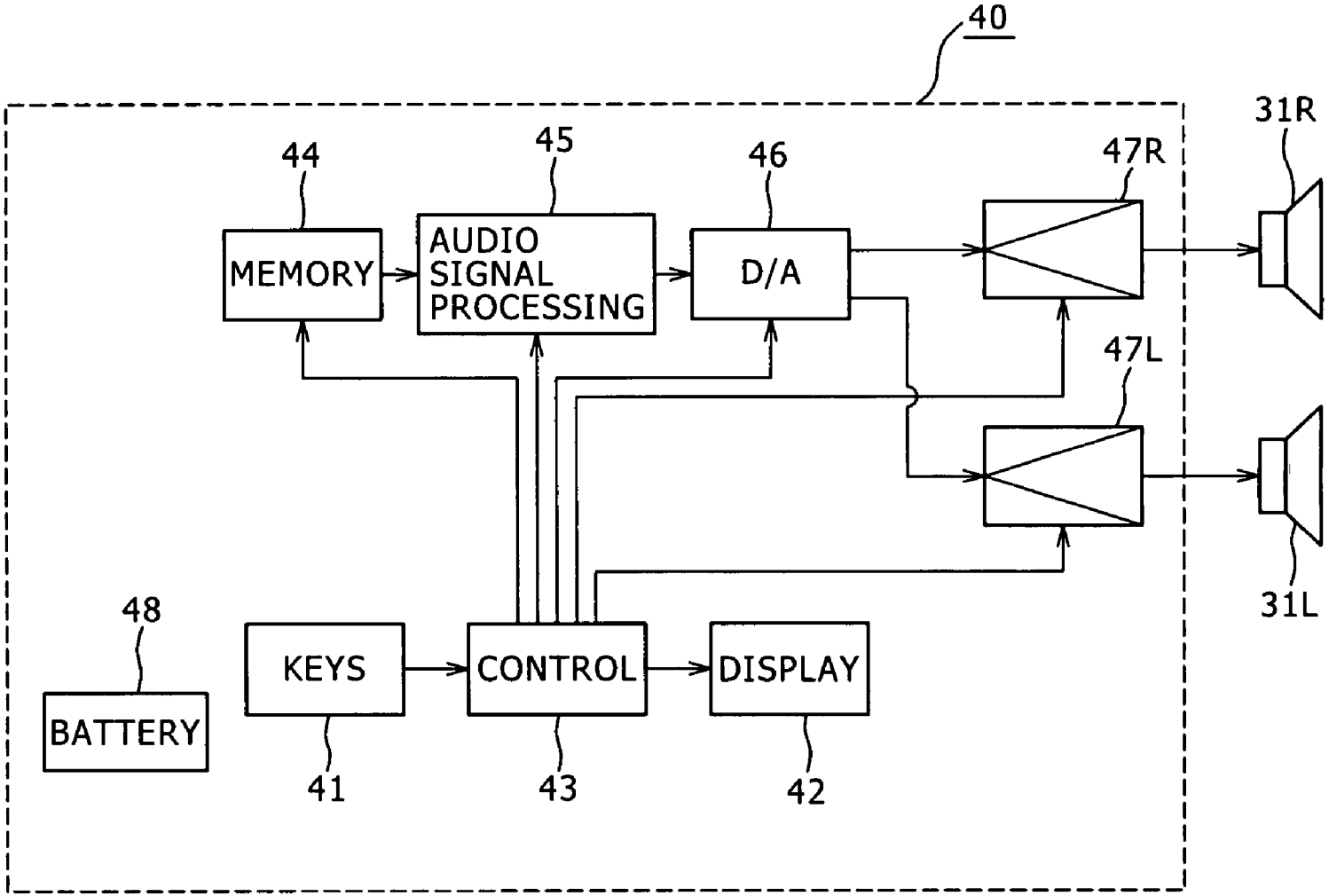
FIG. 4 is a block diagram showing an internal configuration example according to an embodiment of the present invention.

FIG. 4 is a diagram showing an example of an internal configuration of the headphone device of the present embodiment. The casing 40 includes therein the memory 44 for storing audio data and the like, and the audio data stored is read by control of a control section 43. The memory 44 may be either of an built-in type or of a detachable type such as a card-type memory. The audio data outputted from the memory 44 is supplied to an audio signal processing section 45 to execute audio processing for playback through control by the control section 43.

The audio data processed by the audio signal processing section 45 is supplied to a digital-to-analog converter 46 for conversion into an analog audio signal, and then supplied to amplifiers 47L, 47R corresponding to both left and right side channels for amplification for driving the headphone drivers. Thereafter, the amplified outputs are supplied to the driver units 31L, 31R within the left-and-right side headphone housings 30L, 30R, respectively, for output. It should be noted that the casing 40 includes therein a battery 48 (a secondary battery or a primary battery) for supplying power for operating various parts.

Figure 5B:
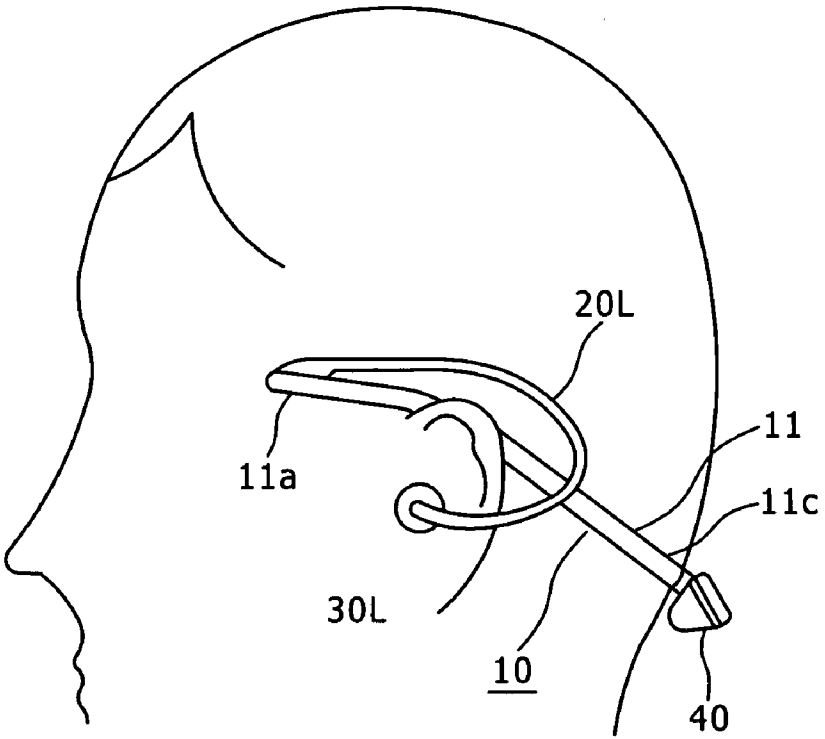
FIG. 5B shows a wearing example of a person with a large head wearing the device.
Figure 5A:
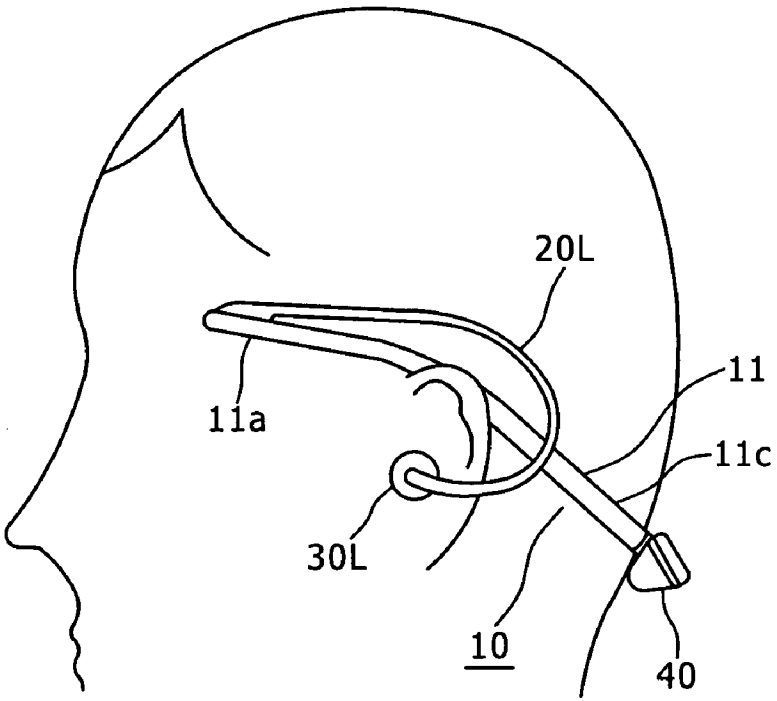
FIG. 5A shows a wearing example of a person with a small head wearing a device.

FIG. 5 is a diagram showing an example of how the headphone device of the present embodiment is worn by a user. The headphone device of the present embodiment is of a type, which can be well-fitted regardless of the head size of a wearer. In other words, FIG. 5A shows an example in which a person whose head is relatively smaller wears the headphone device, and FIG. 5B shows an example in which a person whose head is relatively larger wears the headphone device. As seen from these figures, the wearer wears the headphone device by first allowing the band portion 11 to pass through the gap between the upper end of each of the pinnas and the corresponding temple from the occiput, and then by putting the earpieces 32L, 32R attached to the headphone housings 30L, 30R into the corresponding ears, respectively.

As shown in FIG. 5A, for the person who has a smaller head, the length of a projecting segment of the band portion 11 to the end portions 11*a*, 11*b* from the pinna is longer. On the other hand, as shown in FIG. 5B, for the person who has a bigger head, the length of the projecting segment of the band portion 11 is shorter. Due to these differences in the projecting length, the curvature of the housing connecting members 20L, 20R varies between these two types of wearers. In this way, differences in the head size of wearers can be absorbed by changing the length of the segment of the band portion 11, which is a portion between each of the end portions 11*a*, 11*b* and the corresponding pinna and projecting from the pinna. Thus, no large gap may be created between the occiput and the band portion 11 even if a size adjustment mechanism is not provided on the band portion 11.

In either wearing condition, as shown in FIGS. 5A, 5B, the casing 40 is attached to the outer side of the center portion 11*c* of the band portion 11, and due to the weight of this casing 40, the center portion 11*c* of the band is pulled down so as to bring the center portion 11*c* into contact with the occiput of the wearer, whereby the headphone device is secured in position when worn.

In other words, the headphone device 10 of the present embodiment is sufficiently stable when worn, with little fear of being slipped down even when the wearer is going up and down the stairs, picking something up, or the like. Additionally, the headphone device 10 is simple in construction with no cumbersome adjustment mechanism is required. Furthermore, a board including a power supply and circuit components is arranged in the casing in the middle, whereby the device can be so shaped as to put the band portion in immediate contact with the occiput. Thus, a well-balanced product may be provided. Furthermore, besides the absence of the band adjustment mechanism, due to the band being always put very closely to the occiput regardless of the head size, the headphone device 10 provides an advantage that the wearer hardly feels the weight of the power supply/circuits. Furthermore, even if the headphone device 10 is worn by a user with long hair by putting the band under the long hair, the hair is not ruffled. When the wearer leans against a wall or rests his/her head on a pillow, the band does not slip down. Thus, the headphone device 10 can be worn securely and hence comfortably.

Furthermore, the casing 40 includes therein various circuit components, whereby there is no need to separately arrange the power supply and the circuit components into both left-and-right side housing sections, thereby permitting effective use of spaces and eliminating necessity to arrange the circuit board on one of the left and right sides and the power supply on the other. Thus, there is no need to provide wiring such that each of a power supply line and an audio signal line extends to the housing on the opposite side via the band, with the one line meeting the other. Such a configuration make it possible to implement a simple wiring configuration as well as a symmetrical weight balance, with enhanced wearability.

Figure 6:
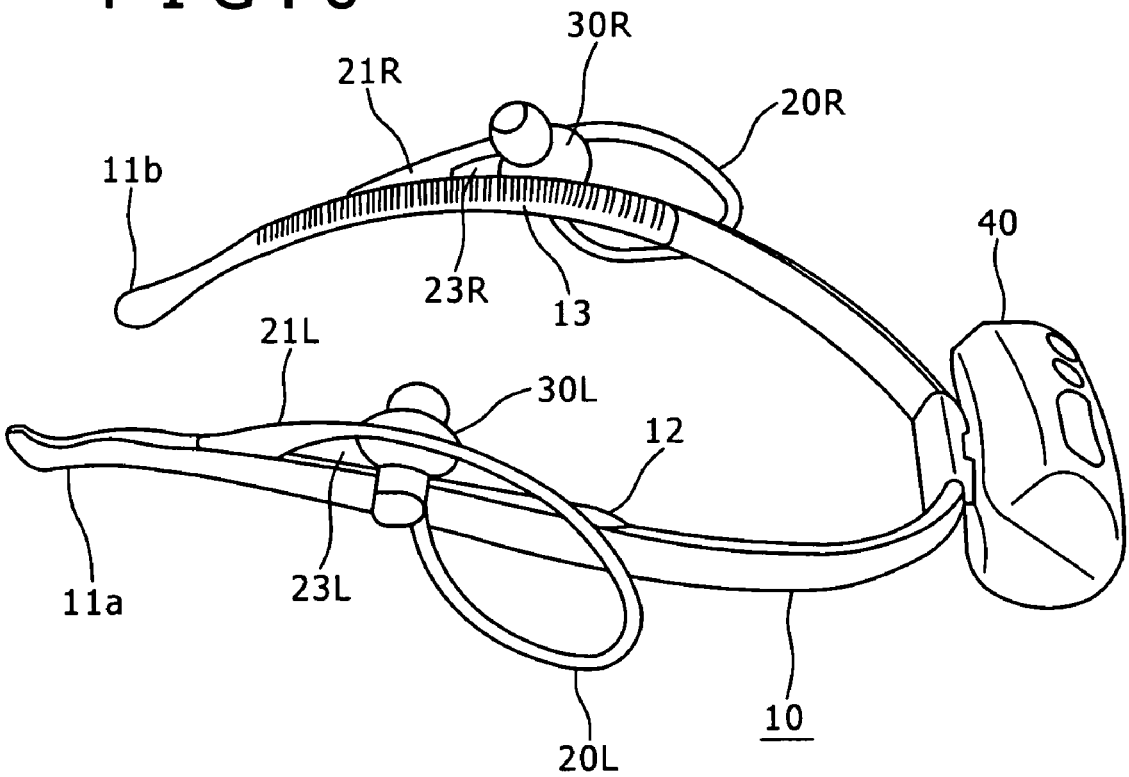
FIG. 6 is a perspective view showing a modified example (an example in which housings can be stored) according to an embodiment of the present invention.

FIG. 6 is a diagram showing an example of how the headphone device 10 of the present embodiment is stored. In this example, the headphone housings 30L, 30R are raised for holding in spaces 23L, 23R between the housing connecting members 20L, 20R and the end portions 11*a*, 11*b* of the band portion 11, respectively. Adopting such a storing method, it is possible to secure the headphone housings 30L, 30R in position for carrying. It should be noted that, in the example of FIG. 6, the headphone housings 30L, 30R are held in position through a simple operation of holding in between. However, as an alternative example, when the housings 30L, 30R are arranged in the above, the band portion 11 or the like near the spaces 23L, 23R may be so shaped as to come into close contact with the housings 30L, 30R, thereby allowing the holding condition to be positively maintained.

It should be noted that the configuration of the circuits arranged within the casing 40 shown in FIG. 4 is only an example, and thus that other audio signal processing circuits may also be included therein. For example, a wireless communication function may be included, so as that an audio signal received by the wireless communication function may be outputted from the driver units 31L, 31R. Furthermore, while the casing 40 itself is attached to the outer side of the band portion 11 in the examples shown in FIGS. 1-3, the casing 40 may alternatively be attached to the inner side of the center portion 11*c* of the band portion 11. However, in this alternative case, it is preferable that the casing 40 has a shape that does not disturb when the device is worn. Still alternatively, the center portion 11*c* or the like of the band portion 11 itself may be made larger in size to include the audio signal processing circuit and the like therein.

Yet alternatively, there may be configured a headphone device having no casing that is provided with the audio signal processing circuit and the like, but having an ordinary headphone cord for connection to external audio playback equipment or the like.

Figure 7:
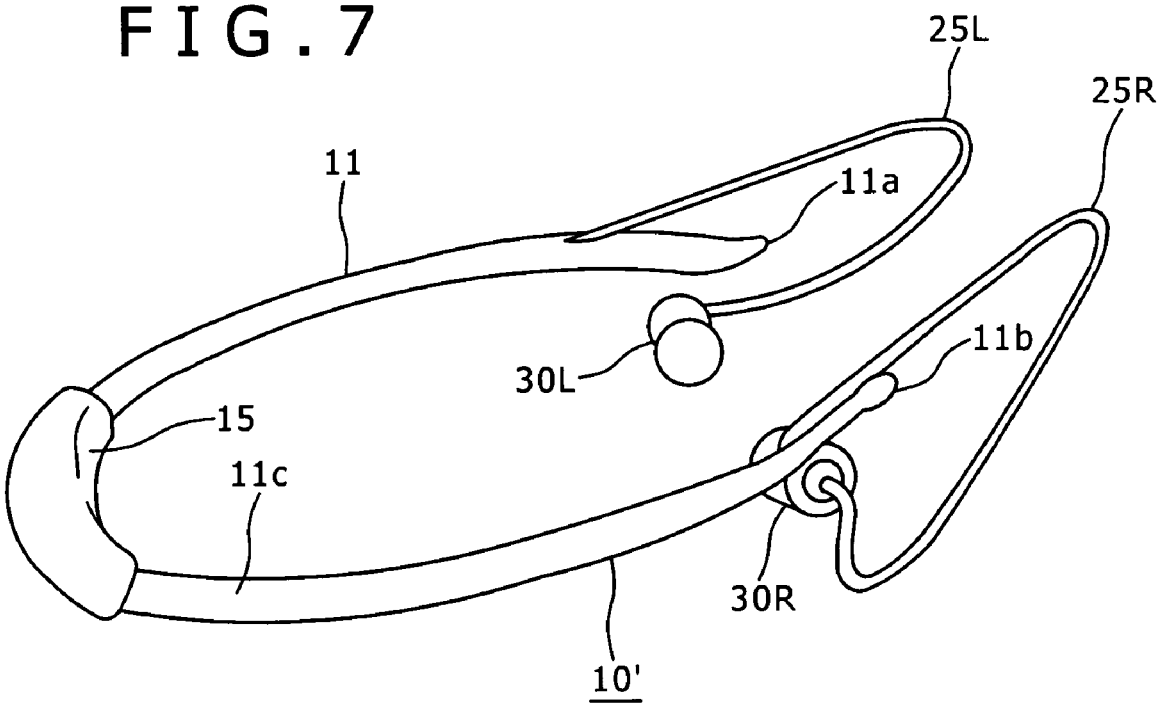
FIG. 7 is a perspective view showing another modified example (an example in which connecting members are differently shaped) according to an embodiment of the present invention.

A headphone device shown in FIG. 7 is an example with no casing. In this example, the headphone device 10' has only a cushion member 15 attached to the center portion 11*c* of the band portion 11. Connecting members 25L, 25R for the headphone housings 30L, 30R have a shape different from that of the examples shown in FIGS. 1-3. Although ends of the connecting members 25L, 25R are connected to the end portions 11*a*, 11*b* of the band portion 11, in this example, the connecting members 25L, 25R are curved in a manner extending from the end portions 11*a*, 11*b* of the band portion 11 toward an opposite direction (toward the face of a wearer). The headphone device 10' thus shaped can also be worn similarly to the headphone device in the examples shown in FIGS. 1-5. It should be noted that in the example of FIG. 7 with no casing, a weight or the like may be included at a position of the center portion 11*c* where the cushion member 15 is arranged, in order to provide a proper weight balance when the device is worn.

Figure 8:
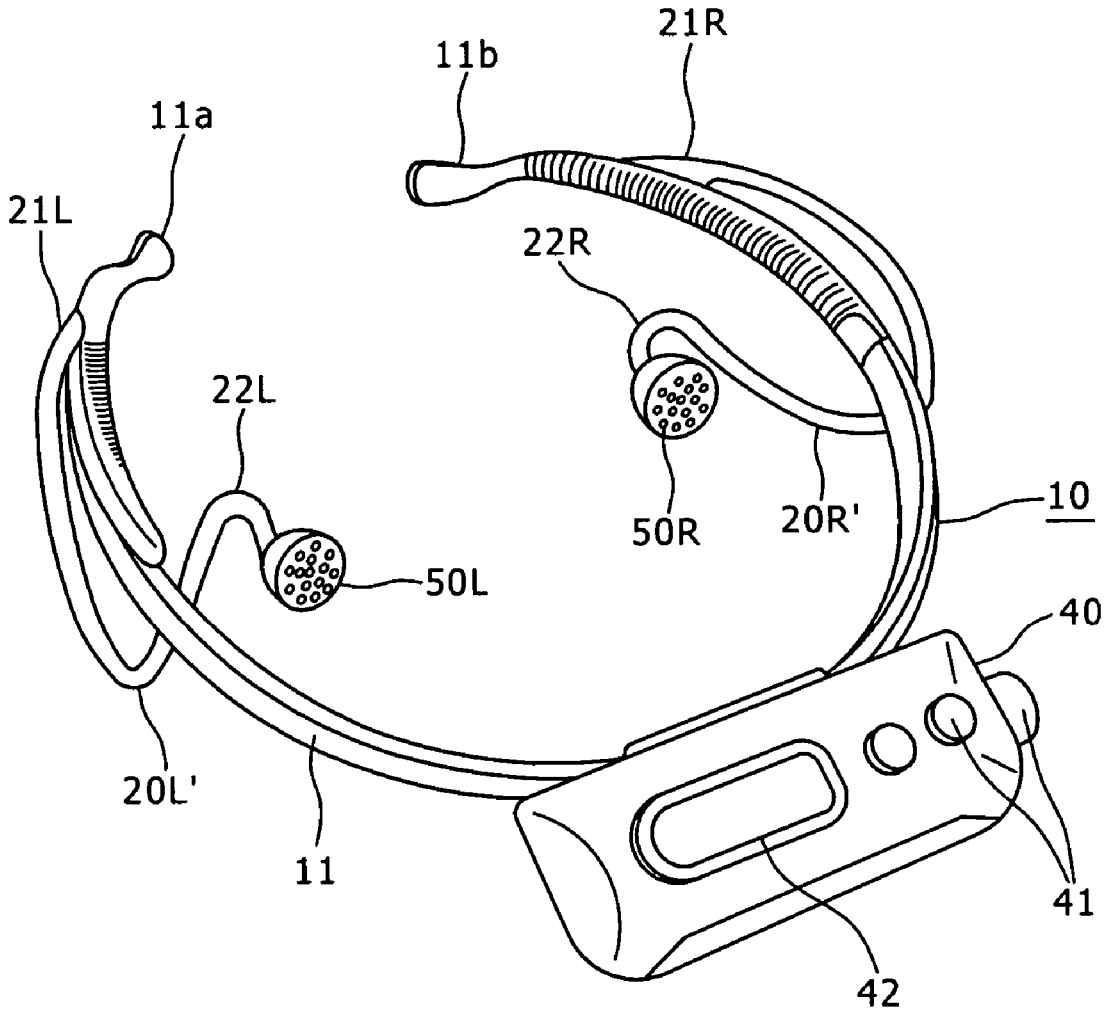
FIG. 8 is a perspective view showing still another modified example (an example in which the housings are arranged perpendicularly) according to an embodiment of the present invention.

Furthermore, the headphone device 10 in the examples of FIGS. 1-5 is so shaped that the earpieces are worn on the ears, but the invention may also be applicable to headphone devices of other wearing types. For example, a headphone device 10 shown in FIG. 8 is of a so-called vertical type in which the headphone device is worn with its audio output surfaces perpendicular to the ears of a wearer. In this case, headphone housings 50L, 50R connected via housing connecting members 20L', 20R' are shaped such that their audio output surfaces face the back of the wearer. Furthermore, although not shown in the figure, it may also be acceptable to attach housings, each including a relatively large driver such as an open air type driver.

Figure 9:
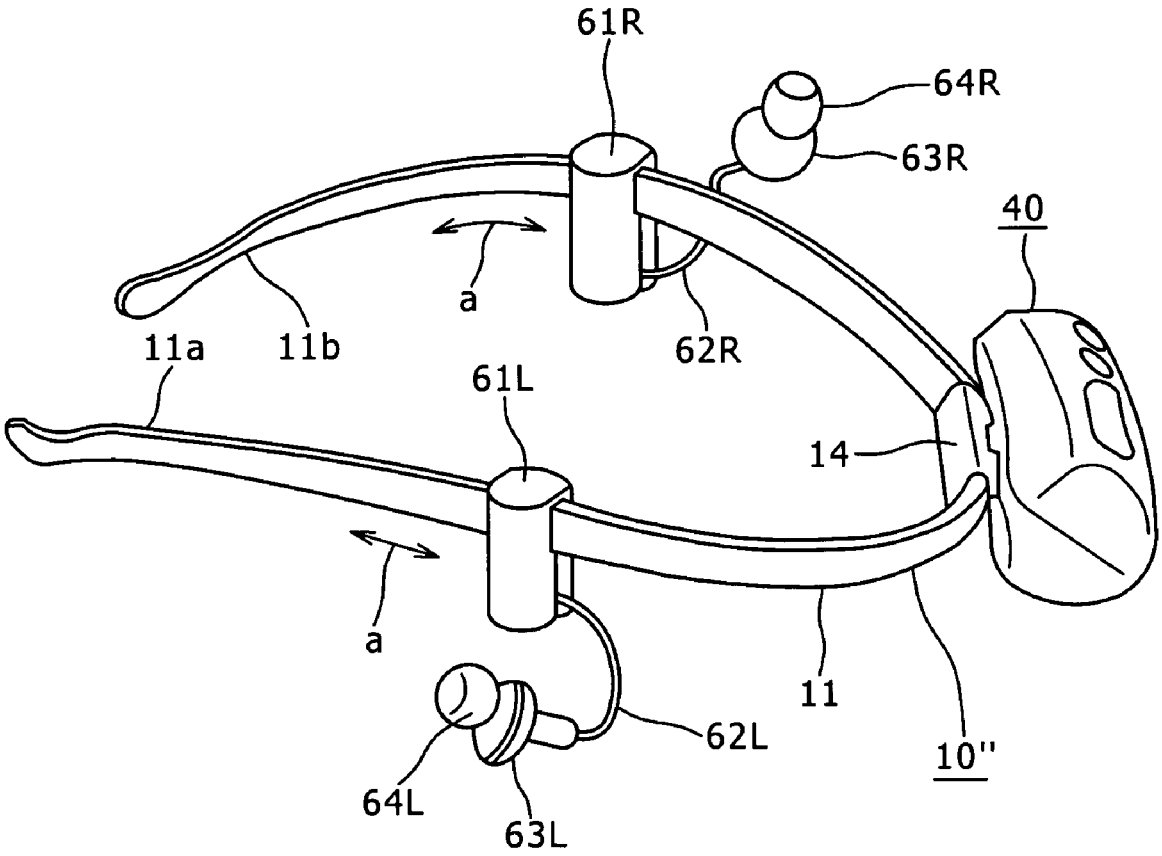
FIG. 9 is a perspective view showing a configuration example (an example of an adjustable type) according to another embodiment of the present invention.

Furthermore, the headphone device having the configurations so far described is designed to absorb differences in size occurring when worn by the curvature of the housing connecting members themselves. However, the headphone device may alternatively be shaped so as to make adjustable the attachment positions of the housing connecting members to the band portion. For example, as shown in FIG. 9, a headphone device 10" may be configured such that housing connecting members 61L, 61R attached to the band portion 11 are movable along the band as shown by an arrow "a" in FIG. 9. The headphone housings 63L, 63R are attached to the band portion 11 via these housing connecting members 61L, 61R and cables 62L, 62R, and then earpieces 64L, 64R attached to these housings 63L, 63R are worn.

Accordingly, even with such an adjustable type, preferable wearing condition may be achieved.

The present invention contains subject matter related to Japanese Patent Application JP 2005-195220 filed in the Japanese Patent Office on Jul. 4, 2005, the entire contents of which being incorporated herein by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A headphone device, comprising:

a band portion having an approximately U-shape, the band portion being configured such that one and the other ends thereof are held on temples near upper ends of left and right pinnas of a wearer and an intermediate portion thereof is positioned at an occiput of the wearer;

left and right side connecting members connected to the band portion, the left and right side connecting members including proximate ends, distal ends, and intermediate portions extending continuously from the proximate ends to the distal ends, wherein the proximate ends are connected to the band portion in front of the pinnas of the wearer, the intermediate portions of the left and right side connecting members project away from and above the band portion as they extend from the connection to the band portion and then arc downward behind the pinnas of the wearer and below the band portion to the distal ends, disposing the distal ends of the left and right side connecting members near auditory canals of the wearer;

left and right side housings connected to the band portion via the left and right side connecting members in a manner hanging from the band portion; and left and right side headphone drivers disposed in the left and right side housings, respectively.

2. The headphone device according to claim 1, further comprising:

at least one cushion member disposed on an inner side of at least part of an arc portion of the band portion.

3. The headphone device according to claim 1, further comprising:

a casing attached to the intermediate portion of the band portion; and an audio signal processor disposed in the casing configured to process audio signals outputted from the left and right side headphone drivers.

4. The headphone device according to claim 3, wherein:

the casing is arranged on an inner side of an arc of the band portion.

5. The headphone device according to claim 3, wherein:

the casing is arranged on an outer side of an arc of the band portion.

6. The headphone device according to claim 1, wherein:

the left and right side connecting members are formed by molding a resin made from an elastic material, the connecting member having a predetermined length.

7. The headphone device according to claim 1, wherein:

the left and right side connecting members are configured such that attachment locations thereof to the band portion are movable.

8. The headphone device according to claim 1, wherein:

the headphone device is of an inner ear type, in which the left and right side housings are worn as horizontally arranged with respect to pinnas of a wearer.

9. The headphone device according to claim 1, wherein:

the headphone device is of a vertical type, in which the left and right side housings are worn as perpendicularly arranged with respect to the left and right pinnas of a wearer.

10. The headphone device according to claim 1, wherein:

the left and right side housings connected to the band portion via the left and right side connecting members in a manner hanging from the band portion are so shaped as to be fitted with predetermined portions of the band portion; and the left and right side housings are fitted with the predetermined portions when stored.

11. The headphone device according to claim 1, wherein:

the band portion comprises at least one upwardly curved portion at a location inward of at least one end of the band portion.

12. The headphone device according to claim 1, wherein:

the left and right side connecting members are flexible.

13. The headphone device according to claim 2, wherein:

the at least one cushion member comprises a plurality of grooves disposed to cover a part of an inner side portion of the cushion member.

14. The headphone device according to claim 13, wherein:

the plurality of grooves extend in a direction crossing a longitudinal direction of the band portion.

15. The headphone device according to claim 3, further comprising:

at least one key disposed on the casing to control the audio signal processor.

16. The headphone device according to claim 3, further comprising:

a display section disposed on the casing to display playback conditions.

17. The headphone device according to claim 3, further comprising:

at least one audio signal line disposed inside the band portion and at least one of the left and right side housing connecting members whereby audio signals output from the casing are supplied to at least one of the left and right side headphone drivers.

18. The headphone device according to claim 3, further comprising:

a casing connecting member to attach the casing to the intermediate portion of the band portion, wherein the casing connecting member comprises a material having a cushioning property.

19. The headphone device according to claim 3, further comprising:

a wireless communication circuit disposed in the casing and in electrical communication with the audio signal processor.

20. The headphone device according to claim 1, wherein the left and right side connecting members extend from the connection towards the intermediate portion of the band portion such that, where the left and right side connecting members project above the band portion, the intermediate portions overlap the band portion in a radial direction from the band portion.

* * * * *